United States Patent [19]

Majaniemi

[11] Patent Number: 4,539,075

[45] Date of Patent: Sep. 3, 1985

[54] PERFORATED SHEET FOR THE HEAD BOX OF A PAPER MACHINE

[75] Inventor: Pekka Majaniemi, Pirkkala, Finland

[73] Assignee: 501 Oy Tampella Ab Lapintie, Tampere, Finland

[21] Appl. No.: 563,031

[22] Filed: Dec. 19, 1983

[30] Foreign Application Priority Data

Jan. 4, 1983 [FI] Finland ..... 830016

[51] Int. Cl.[3] ..... D21F 1/02

[52] U.S. Cl. ..... 162/343; 162/272; 162/336

[58] Field of Search ..... 162/343, 338, 336, 272

[56] References Cited

U.S. PATENT DOCUMENTS

| | | | |
|---|---|---|---|
| 2,736,247 | 2/1956 | Hornbostel | 162/343 |
| 3,791,918 | 2/1974 | Koskimies et al. | 162/343 |
| 3,962,031 | 6/1976 | Bubik et al. | 162/343 |
| 3,970,513 | 7/1976 | Lehtinen | 162/343 |
| 4,146,427 | 3/1979 | Hogel et al. | 162/343 |
| 4,198,270 | 4/1980 | Kurth et al. | 162/343 |

FOREIGN PATENT DOCUMENTS 422091 2/1982 Sweden .

*Primary Examiner*—William F. Smith
*Assistant Examiner*—K. M. Hastings
*Attorney, Agent, or Firm*—Ladas & Parry

[57] ABSTRACT

Perforated sheet for a head box of a paper machine, the perforated sheet being provided with a number of parallel flow passages starting from a common front face. The perforated sheet is provided with a set of feeding ducts which can be connected to a source of flushing liquid and which is connected, by means of flushing ducts, to the front face of the perforated sheet. The perforated sheet preferably consists of several rod elements, each of which is provided with a flow passage and which have been assembled as parallel to each other, side by side and one above the other, into an integrated package.

6 Claims, 5 Drawing Figures

PERFORATED SHEET FOR THE HEAD BOX OF A PAPER MACHINE

Figure 1:
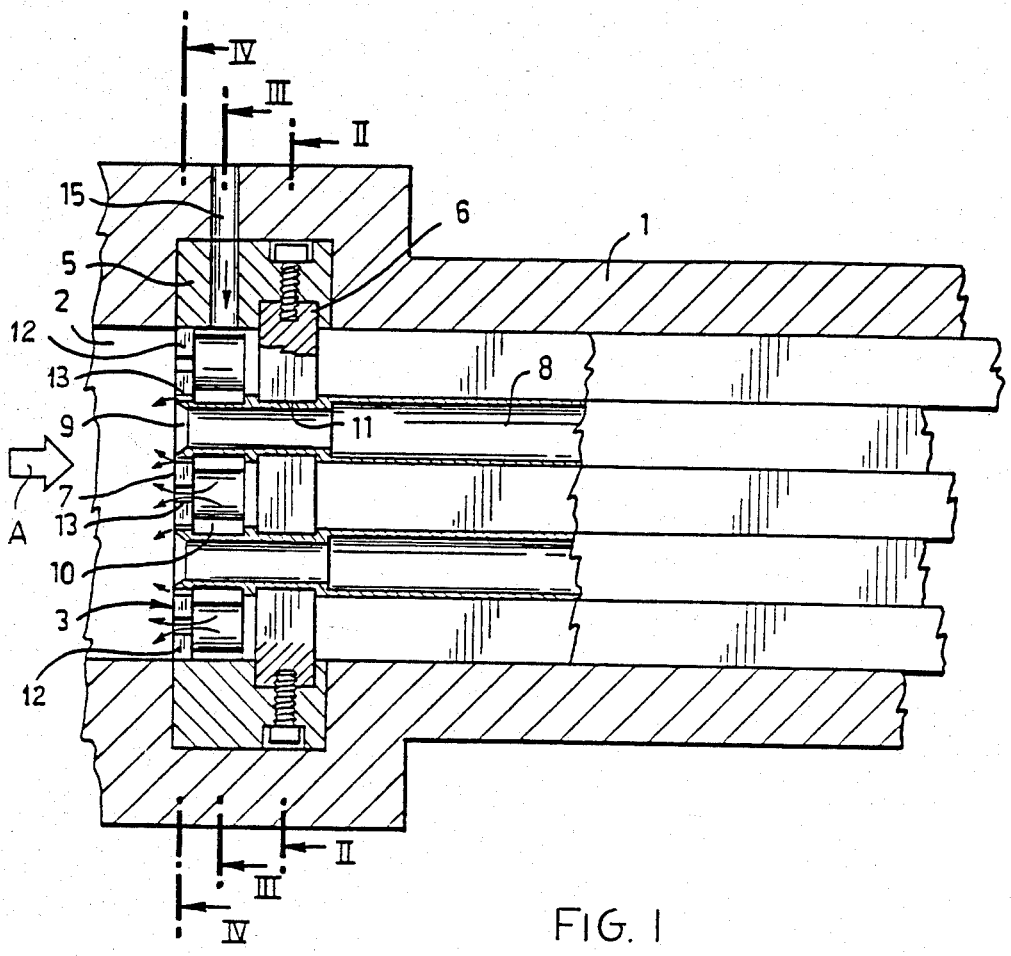

The present invention is concerned with a perforated sheet for a head box of a paper machine, said perforated sheet being provided with a number of parallel flow passages starting from a common front face.

Such a perforated sheet is used in the head box of a paper machine as a distributor and turbulence-formation device for the stock flow. The perforated sheets, however, involve the problem that the front face of the sheets becomes contaminated, and some of the inlet openings of the holes may be even blocked during operation. When the stock flow collides against the front face of the perforated sheet, fibre agglomerations are produced at the symmetry centres of the inlet openings located at the front face, in so-called dam points, which agglomerations are detached in the course of time and cause web interference and even breaks.

Attempts have been made to eliminate blocking of the inlet openings of flow passages in the perforated sheet mainly by shaping the inlets of the openings so that they should remain unblocked as long as possible. The method most commonly used is the use of chamfering at the edge of the inlet opening.

In the SE Patent Publication No. 422,091 it is suggested that an elevation be formed in front of the inlet opening of each flow passage, by the effect of which elevation the stock flow is forced to turn in the direction of the inlet opening before the stock flow collides against the down-stream-side edge of the inlet opening. In this way, it is possible to reduce the gathering of fibre bundles at the inlet of the opening.

However, by means of the prior-art solutions described above, sufficiently good results have not been obtained, but fibre agglomerations do, nevertheless, occur. Moreover, the solutions suggested in said patent publication are complicated and expensive.

It is an object of the present invention to provide a perforated sheet that eliminates the above drawbacks and permits an efficient keeping of the front face of the perforated sheet clean from fibres. This objective is achieved by means of a perforated sheet in accordance with the present invention, which is characterized in that the perforated sheet is provided with a set of feeding ducts which can be connected to a source of flushing liquid and which is connected, by means of flushing ducts, to the front face of the perforated sheet.

The invention is based on the idea that the front face of the perforated sheet is kept clean from fibres by means of an external flushing liquid, which is constantly flowing onto the front face of the perforated sheet and which thereby prevents gathering of fibres at the dam points and at other points of the front face that tend to gather fibres. The quantity of flushing liquid fed into the stock flow is insignificantly little and does not affect the flow state and the properties of the stock in any way.

It is preferable that the perforated sheet consists of several rod elements, each of which is provided with a flow channel and which have been assembled as parallel to each other, side by side and one above the other into integrated packages, and that each rod element is provided with a feeding duct parallel to the front face of the perforated sheet, and said feeding duct being connected with the feeding ducts of the adjoining rod elements and with the flushing ducts passing to the front face.

Owing to such a construction, the feeding ducting by means of which the flushing liquid is introduced into the perforated sheet can be provided easily inside the perforated sheet, and the flushing ducts passing from the feeding ducting into the front face can likewise be provided easily in the perforated sheet, because both duct types can be formed as open grooves in the faces of the rod elements.

Figure 2:
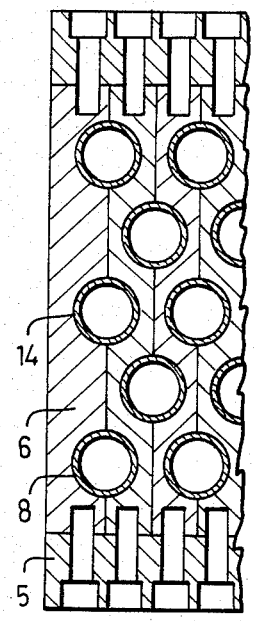
Figure 3:
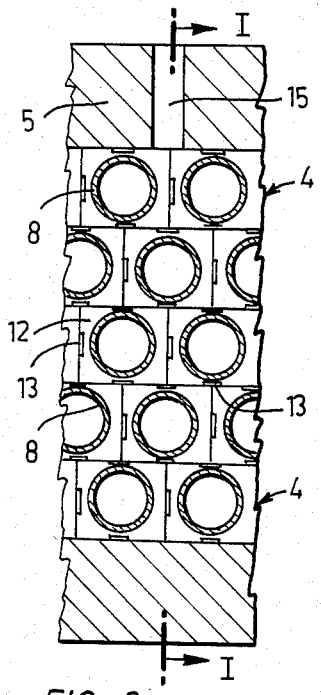
Figure 4:
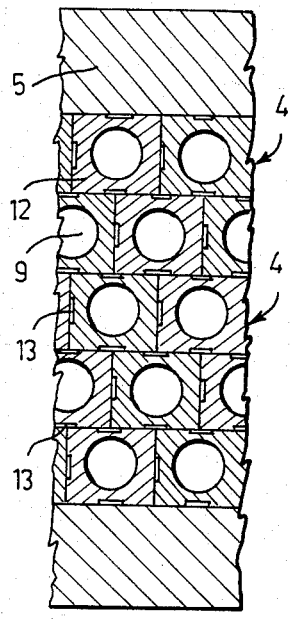
Figure 5:
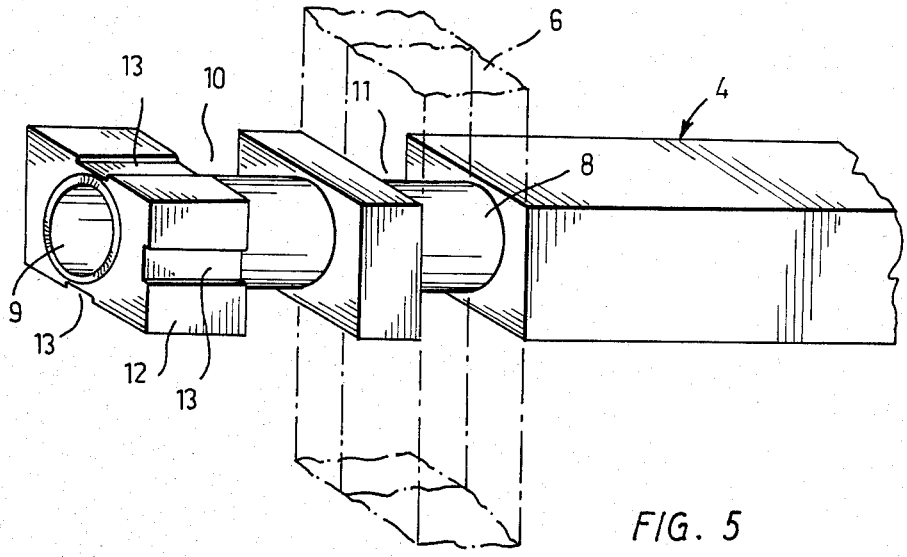

The invention will be described in more detail below with reference to the attached drawings, wherein FIG. 1 shows a perforated sheet in accordance with a preferred embodiment of the invention as installed in the flow passage of the head box as seen as a section in the direction of flow substantially along line I—I in FIG. 3 (certain plane faces have been shown as sectional views for the sake of clarity of illustration), FIGS. 2, 3 and 4 are sectional views of the perforated sheet substantially along lines II—II, III—III and IV—IV, respectively, in FIG. 1, and FIG. 5 is an enlarged perspective view of one rod element of the perforated sheet.

FIG. 1 in the drawings shows the frame 1 of the head box, and the perforated sheet 3 is installed in the flow chamber 2 formed by the frame 1 at the point between the distribution box, not shown, and the slice, not shown. The direction of flow of the fibre stock is denoted with reference letter A. The perforated sheet consists of several rod elements 4 of rectangular section, FIG. 5, which elements are installed parallel to each other side by side and one above the other as a tight package, FIG. 3, which is attached to the frame of the head box by means of a support frame 5. The individual rod elements are locked to each other, and the entire package is locked to the support frame by means of fastening rods 6, which will be described in more detail in the following. The rod elements assembled together form a front face 7 transverse to the stock flow on the upstream side.

Each rod element is provided with a longitudinal flow passage 8, which forms an inlet opening 9 in the front face. At a distance from the front face, into the element, a groove-shaped feeding duct 10 annularly surrounding the flow passage has been formed, which feeding duct is open radially outwards, as comes out from FIG. 5. At a distance from the feeding duct, a similar locking groove 11 has been made into the element. Into the three faces of the portion 12 of material between the front face of the element and the feeding duct, flushing ducts 13 consisting of shallow grooves have been formed.

When the rod elements have been assembled into a package, the feeding ducts 10 and, correspondingly, the locking grooves 11 become positioned so that they face each other. The rod elements have been locked to each other as axially immobile by means of fastening rods 6 extending between them, the said rods becoming positioned in the locking grooves 11 of the elements. The fastening rods are provided with notches 14 required by the flow passages in the elements, FIG. 2, whereas the outer face of the flow passages is preferably round and the notches in the rods 6 semi-circular. The fastening rods 6 have been locked to the support frame 5 in some appropriate way, such as, e.g., by bolts.

The feeding ducts 10 in the rod elements, facing each other, form an integrated ducting parallel to the front face. The support frame and the frame of the head box are provided with a duct 15, which can be connected to a source of flushing liquid.

It is noticed from FIG. 1 in particular that the flushing liquid flows from the duct 15 into the feeding ducts 10 in the rod elements and from them through the flushing ducts 13 to the front face 7. The flushing ducts terminate in the dam points of the front face, and the flushing liquid constantly flowing out keeps the front face clean from fibres.

The pressure in the flushing liquid must be at least equal to the pressure in the stock flow.

The depth of the grooves forming the flushing ducts may be, e.g., 0.1 to 0.5 mm, whereat the constant flow of the flushing liquid keeps them clean. Water is advantageously used as the flushing liquid.

The rod elements are advantageously made of plastic.

The drawings and the related description are only intended as an illustration of the idea of the invention. In its details, the perforated sheet in accordance with the invention may show variation within the scope of the patent claims.

What is claimed is:

1. A perforated sheet for a head box of a paper machine, comprising several rod elements each including a flow passage, said flow passages arranged in parallel into an integrated package and starting from a common front face of said perforated sheet and having inlet openings;

said rod elements each being integrally formed with a feeding duct, said feeding ducts being substantially parallel to said front face of said perforated sheet and being connected to a source of flushing liquid to feed said flushing liquid through said feeding ducts; and said rod elements each being integrally formed with a flushing duct, said flushing ducts connecting said feeding ducts to said front face, and terminating in said front face at points between said inlet openings of said passages.

2. Perforated sheet as claimed in claim 1, wherein said feeding duct in a rod element surrounds said flow passage annularly and is radially open outwards.

3. Perforated sheet as claimed in claim 2, wherein each rod element is provided with at least one flushing duct parallel to said flow passage and placed in the face of a portion of material between said feeding duct and said front face.

4. Perforated sheet as claimed in claim 1, wherein said rod elements have been assembled into a support frame and connected to said frame by means of fastening rods extending between said rod elements.

5. Perforated sheet as claimed in claim 4, wherein each rod element is provided with a locking groove for said fastening rods.

6. Perforated sheet as claimed in claim 1, wherein said rod elements have a rectangular cross-sectional shape.

* * * * *